US009799195B2

(12) United States Patent
Lu et al.

(10) Patent No.: US 9,799,195 B2
(45) Date of Patent: Oct. 24, 2017

(54) EARTHQUAKE ALARM BROADCASTING EQUIPMENT AND METHOD THEREOF

(71) Applicant: National Applied Research Laboratories, Taipei (TW)

(72) Inventors: Kung-Chun Lu, Hsinchu (TW); Hung-Wei Chiang, Tainan (TW); Shieh-Kung Huang, Taoyuan (TW); Pei-Yang Lin, Taipei (TW); Ting-Yu Hsu, New Taipei (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 14/955,062

(22) Filed: Dec. 1, 2015

(65) Prior Publication Data

US 2016/0203697 A1 Jul. 14, 2016

(30) Foreign Application Priority Data

Jan. 8, 2015 (TW) ..... 104100555 A

(51) Int. Cl.
*G08B 21/00* (2006.01)
*G08B 21/10* (2006.01)
*G08B 27/00* (2006.01)

(52) U.S. Cl.
CPC ..... *G08B 21/10* (2013.01); *G08B 27/00* (2013.01)

(58) Field of Classification Search
CPC ..... G08B 21/10
USPC .... 340/690, 286.02, 506, 539.1, 601; 702/3, 702/15, 179; 705/7.12, 35
See application file for complete search history.

(56) References Cited

U.S. PATENT DOCUMENTS 5,910,763 A * 6/1999 Flanagan ..... G08B 21/10 340/286.02
2011/0018706 A1* 1/2011 Egawa ..... G08B 25/009 340/539.1
2013/0328688 A1* 12/2013 Price ..... G01V 1/008 340/690

FOREIGN PATENT DOCUMENTS

CN 101946268 A 1/2011
TW 201405493 2/2014
WO 0051093 8/2000

* cited by examiner

*Primary Examiner* — Dhaval Patel
(74) *Attorney, Agent, or Firm* — Winston Hsu

(57) ABSTRACT

An earthquake alarm broadcasting equipment for an earthquake detecting system includes a receiver for receiving a detection result from the earthquake detecting system, wherein the detection result at least indicates a level of earthquake intensity, a memory device for storing a trigger level, a use scenario set by a user and a contingency measure corresponding to the use scenario, a processor coupled to the receiver and the memory device for generating a control signal according to the detection result, the trigger level and the contingency measures, and a functional module coupled to the processor for broadcasting an earthquake alarm and the contingency measures to the user.

8 Claims, 3 Drawing Sheets

EARTHQUAKE ALARM BROADCASTING EQUIPMENT AND METHOD THEREOF

BACKGROUND OF THE INVENTION

1. Field of the Invention

The present invention relates to an earthquake alarm broadcasting equipment method thereof, and more particularly, to an earthquake alarm broadcasting equipment method thereof capable of receiving earthquake detecting results to determine whether to broadcast an earthquake alarm and corresponding contingency measure to users.

2. Description of the Prior Art

Considering damages and property losses due to earthquakes, governments and bureaus have founded earthquake observation centers to observe characteristics and information (e.g., times, locations, types) of seismic waves. However, since instruments for observing the seismic waves are fragile and intricate to be much expensive, it could be impractical to place such intricate instruments in everywhere, which results in a low penetration rate of earthquake observation center. Therefore, the information associated with the earthquakes is usually broadcasted by mass media such as television, radio broadcast, the Internet to the people.

However, a way for broadcasting earthquakes may be less instant and have a less penetration to the people. In practice, the people learns earthquake alarms after the seismic waves had ended, which leads that the people has no time take contingency measures and causes irreparable damages to the people and their property. Moreover, the earthquake alarms are from only one source and there is no contingency measure provided to the people. As a result, the people not encountered the earthquakes could be bothered by the earthquake alarms, and the people encountered the earthquakes cannot take the contingency measure to protect them from life hazard and property loss.

Therefore, there is a need to improve prior art.

SUMMARY OF THE INVENTION

It is therefore an objective of the present invention to provide an earthquake alarm broadcasting equipment method thereof for receiving earthquake detecting results to determine whether to broadcast an earthquake alarm and corresponding contingency measure to users.

The present invention discloses an earthquake alarm broadcasting equipment for an earthquake detecting system includes a receiver, a memory device, a processor and a functional module. The receiver is used for receiving a detection result from the earthquake detecting system, wherein the detection result indicates at least a level of earthquake intensity. The memory device for storing a trigger level, a use scenario set by a user and a contingency measure corresponding to the use scenario. The processor coupled to the receiver and the memory device for generating a control signal according to the detection result, the trigger level and the contingency measures. The functional module coupled to the processor for broadcasting an earthquake alarm and the contingency measures corresponding to the use scenario to the user according to the control signal.

The present invention further discloses a method of broadcasting earthquake alarm for an earthquake detecting equipment of an earthquake detecting system includes receiving a detection result from the earthquake detecting system, wherein the detection result indicates at least a level of earthquake intensity, and storing a trigger level, a use scenario set by a user and a contingency measure corresponding to the use scenario; generating a control signal according to the detection result, the trigger level and the contingency measures; and broadcasting an earthquake alarm and the contingency measures corresponding to the use scenario to the user according to the control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
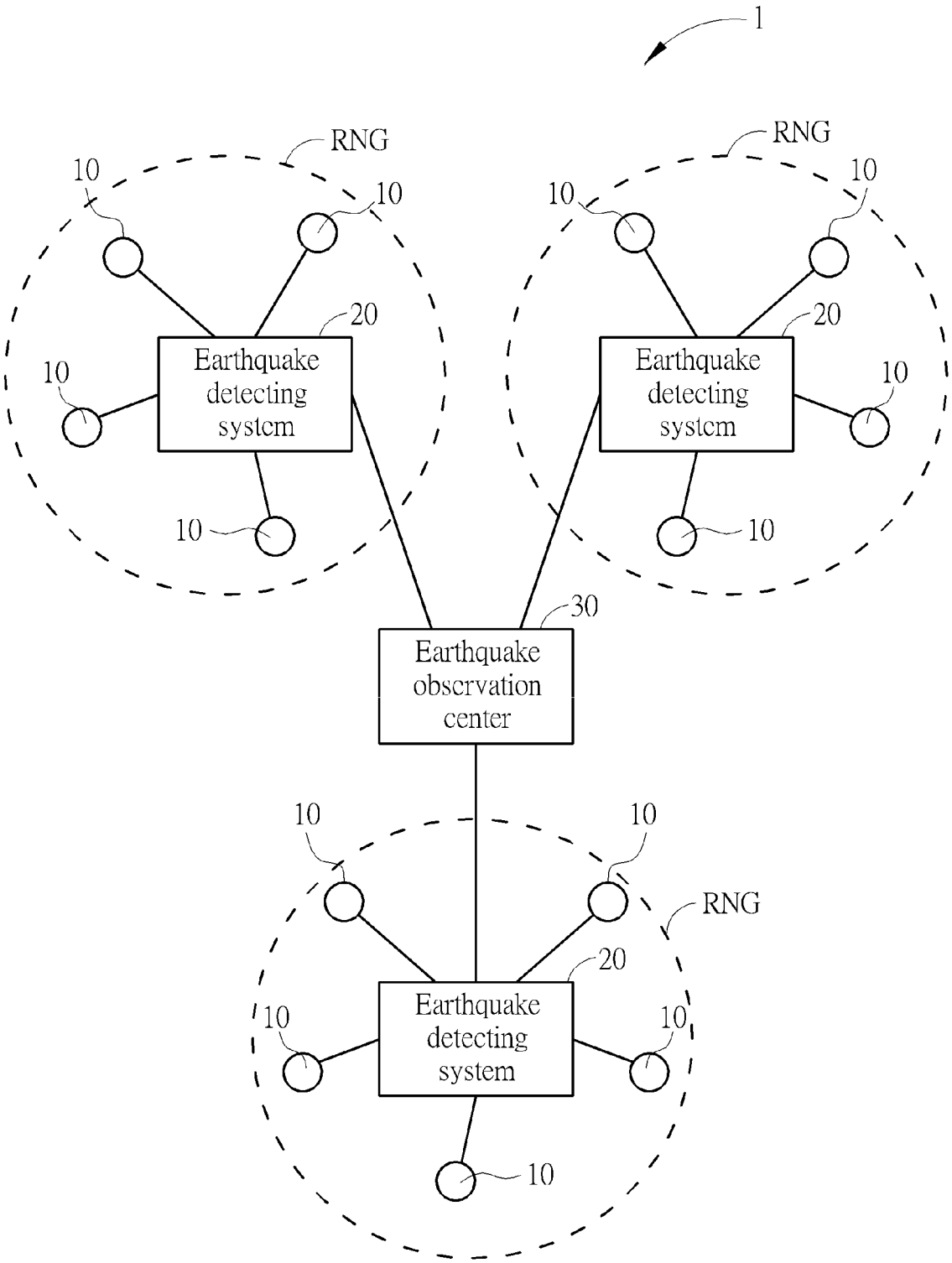
FIG. 1 is a schematic diagram of an earthquake alarm broadcasting system.

Please refer to FIG. 1, which is a schematic diagram of an earthquake alarm broadcasting system 1. The earthquake alarm broadcasting system 1 includes a plurality of earthquake alarm broadcasting equipment 10, a plurality of earthquake detecting systems 20 and an earthquake observation center 30. The earthquake detecting system 20 may be regarded as a on-site earthquake detecting station for detecting seismic waves within an alarm range RNG for twenty-four hours a day, analyzing earthquake information (an earthquake magnitude, a distance to an epicenter, a local seismic intensity and an arrival time of maximum seismic waves, peak ground acceleration, peak ground velocity, peak ground displacement, seismic dominate frequency, etc.) according to the detected seismic waves, and synchronously transmitting the earthquake information to all earthquake alarm broadcasting equipment 10 in the alarm range RNG. The earthquake alarm broadcasting equipment 10 may receive the earthquake information to determine whether to broadcast earthquake alarms and corresponding contingency measure to users. As a result, the user may learn that the earthquake is about to happen and the earthquake information from the earthquake alarm broadcasting equipment 10 so as to take the contingency measure, which helps the users to protect them from life hazard and reduces property lost.

Moreover, the earthquake detecting system 20 may be connected to the earthquake observation center 30 to exchange the earthquake information to obtain the earthquake information with more accuracy by aligning the earthquake information from the earthquake detecting system 20 and the earthquake observation center 30. Then, the earthquake observation center 30 may broadcast the earthquake information with more accuracy to all earthquake detecting system 20 within its alarm range RNG. Therefore, the earthquake detecting system 20 may transmit the earthquake information from the earthquake observation center 30 to the earthquake alarm broadcasting equipment 10, such that the earthquake alarm broadcasting equipment 10 may determine whether to broadcast the earthquake alarm and the corresponding contingency measure to the users. As a result, when earthquake occurs out of the alarm range RNG, the earthquake alarm broadcasting equipment 10 may receive the earthquake information in advance to inform the users to take contingency measure, so as to evacuate people from potential hazards before the seismic waves arrive at the alarm range RNG, which helps to reduce potential personal and economic damages.

Figure 2:
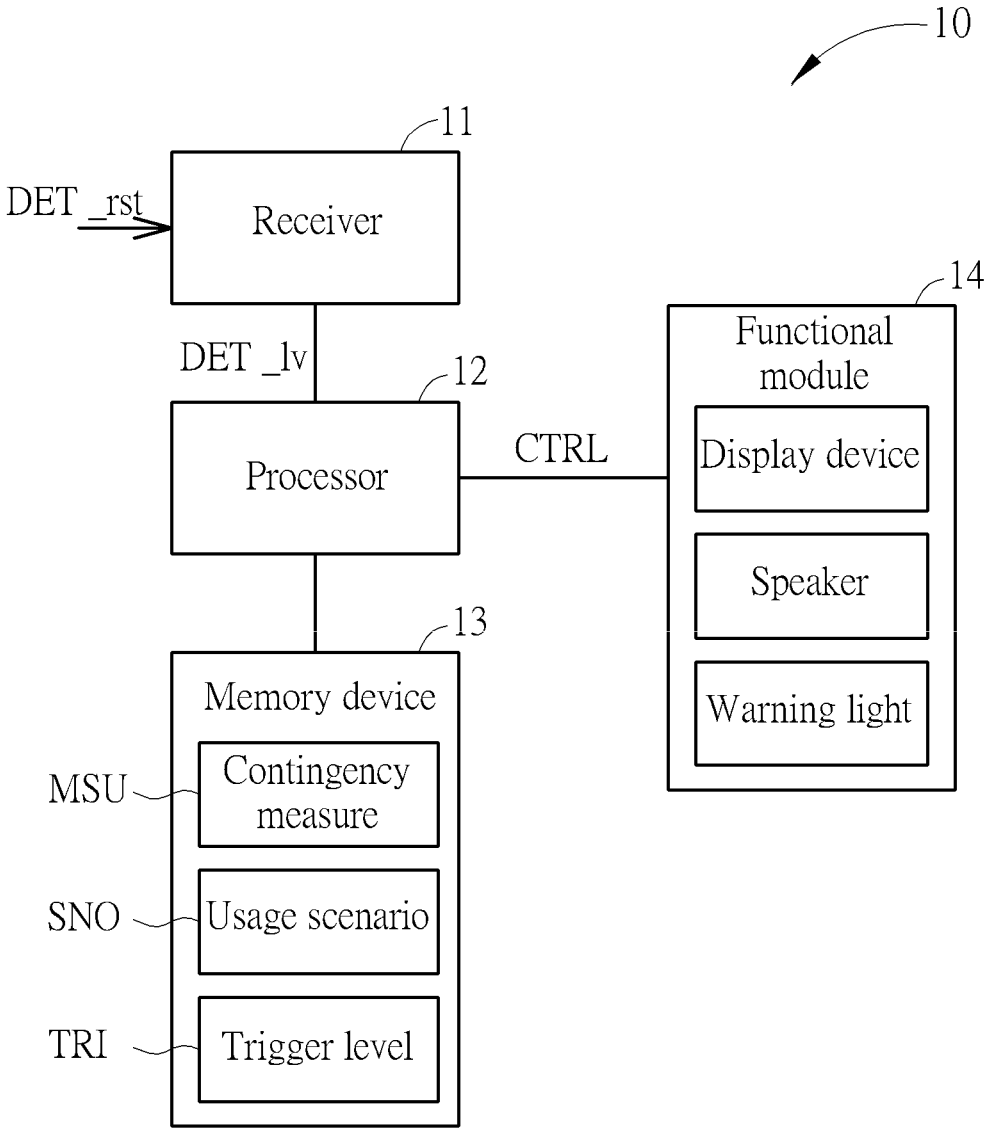
FIG. 2 is a functional block diagram of the earthquake alarm broadcasting equipment shown in FIG. 1 according to an embodiment of the present invention.

Please refer to FIG. 2, which is a functional block diagram of the earthquake alarm broadcasting equipment 10 according to an embodiment of the present invention. The earthquake alarm broadcasting equipment 10 includes a receiver 11, a processor 12, a memory device 13 and a functional module 14. The receiver 11 may be used for receiving a detection result DET_rst from the earthquake detecting system 20, wherein the detection result DET_rst may indicate at least a level of earthquake intensity DET_lv. Information indicated by the detection result DET_rst may be unlimited, the information may include a earthquake magnitude, a distance to an epicenter, a local seismic intensity and an arrival time of maximum seismic wave, peak ground acceleration, peak ground velocity, peak ground displacement, seismic dominate frequency, etc. The memory device 13 may be used for storing a trigger level TRI, a usage scenario SNO and a contingency measure MSU corresponding to the usage scenario SNO which are set by the users.

The processor 12 may be coupled to the receiver 11, the memory device 13 and the functional module 14 for determining whether to broadcast the earthquake alarm and the contingency measure MSU corresponding to the usage scenario SNO to the users according to the level of earthquake intensity DET_lv indicated by the detection result DET_rst and the trigger level TRI set by the user. If the level of earthquake intensity DET_lv indicated by the detection result DET_rst is greater than or equal to the trigger level TRI, the processor 12 may generate a control signal CTRL to the functional module 14 according to the contingency measure MSU corresponding to the usage scenario SNO. On the contrary, if the level of earthquake intensity DET_lv indicated by the detection result DET_rst is smaller than the trigger level TRI, the processor 12 may not generate the control signal CTRL to the functional module 14. The functional module 14 may be used for broadcasting the earthquake alarm message and the corresponding contingency measure MSU to the users according to the control signal CTRL.

Noticeably, the usage scenario SNO may be customized to provide the more suitable contingency measure MSU to the users to cater to user requirements. The usage scenario SNO may indicate at least a geologic (e.g., a fault zone), a region (e.g., metropolis, urban or mountain region), an interior/exterior including high or low levels, a population density, an economic value of a building and a fragility, to evaluate potential threat and economic hazard that the earthquake may bring to the users, so as to plan the suitable contingency measure MSU.

For general environments, when earthquake happens, the suitable contingency measure MSU may guide the users inside a low level of a building to evacuate to outdoor region, and the suitable contingency measure MSU may guide the users inside a high level of the building to cover themselves locally, e.g. under a cover of firm furniture or stay around a pillar of the building.

Further, the trigger level TRI may be set by the users, which ensures that the earthquake alarm is broadcasted only when needed to prevent the users from frequent false alarms. For example, for the users in the fault zone that the earthquakes happen frequently, herein the earthquakes with medium and/or low levels of earthquake intensity are considered to be a normal event, and which brings relative low potential threat based on experiences in the past. Therefore, the users shall be alerted only when the earthquakes with a high level of earthquake intensity happens. In such a situation, the users may set the trigger level TRI to the earthquake intensity DET_lv with a high level (e.g., fourth level of the earthquake intensity), so the earthquake alarm broadcasting equipment 10 may broadcast the earthquake alarm if the level of earthquake intensity DET_lv indicated by the detection result DET_rst is equal to or greater than the fourth level of the earthquake intensity. On the contrary, the earthquake alarm broadcasting equipment 10 may not broadcast the earthquake alarm if the level of the earthquake intensity DET_lv indicated by the detection result DET_rst is smaller than the fourth level of the earthquake intensity, which prevents the users from frequent false alarms.

On the other hand, for economic concerns, buildings or factories having intricate structures and high cost, such as a semi-conductor plant, a laboratory and a nuclear power plant, the earthquakes with the medium and/or low level of earthquake intensity may ruin the economic buildings, equipment and/or products of the economic buildings. Therefore, the users may set the trigger level TRI to the earthquake intensity DET_lv with a low level (e.g., second level of the earthquake intensity). Therefore, the earthquake alarm broadcasting equipment 10 may broadcast the earthquake alarm if the level of earthquake intensity DET_lv indicated by the detection result DET_rst is equal to or greater than second level of the earthquake intensity.

In short, the earthquake alarm broadcasting equipment 10 of the present invention may receive the earthquake detecting result detected by the earthquake detecting system 20 within its alarm range to determine whether to broadcast the earthquake alarm and the corresponding contingency measure to the users, and the earthquake alarm broadcasting equipment 10 may guide the users to take contingency measure accordingly, so as to protect them from life hazard and reduces property lost. In addition, the earthquake alarm broadcasting equipment 10 may receive the earthquake information from the earthquake observation center 30 in advance to inform the users to take contingency measure, so as to evacuate people from potential hazards before the seismic waves arrive at the alarm range, which helps to reduce potential personal and economic damages. The earthquake alarm broadcasting equipment 10 of the present invention allows the usage scenario to be customized to provide the more suitable contingency measure to the users to cater to user requirements. Those skilled in the art may take modifications and alterations accordingly, which is not limited in the embodiments of the present invention.

For example, the earthquake alarm broadcasting equipment 10 may be realized by an independent electronic device or integrated in another electronic device. The electronic device connected to the earthquake detecting system 20 and capable of broadcasting the earthquake alarm to the users shall take place of the earthquake alarm broadcasting equipment 10 of the present invention, such as an E-clock, an E-board, a community broadcast system, a monitor, a personal computer, a mobile phone, and so on. By integrating the earthquake alarm broadcasting equipment 10 in the electronic devices utilized in everywhere, the broadcast earthquake alarm may be widely sent to most of the users to take the corresponding contingency measure.

The functional module 14 may be a display device, a warning light, a speaker, a buzzer, or a combination of those abovementioned. The functional module 14 may drive its integrated elements to broadcast the earthquake alarm and the contingency measure MSU to the users according to the control signal CTRL transmitted from the processor 12. Specifically, the functional module 14 may drive the display device to display characters or patterns to demonstrate the contingency measure MSU, drive the speaker to broadcast the contingency measure MSU by voice, or drive the warning light to demonstrate an escape route to the users.

The receiver 11 may support a wired transmission interface (e.g., an RS485 transmission interface, power line transmission, the Internet) or a wireless transmission interface (e.g., a third-generation communication system, Wi-Fi, satellite communication), such that the earthquake alarm broadcasting equipment 10 may be connected to the earthquake detecting system 20 via wired or wireless communications to receive the detection result DET_rst. In addition, the earthquake detecting system 20 may be connected to the earthquake observation center 30 via wired or wireless communications.

Figure 3:
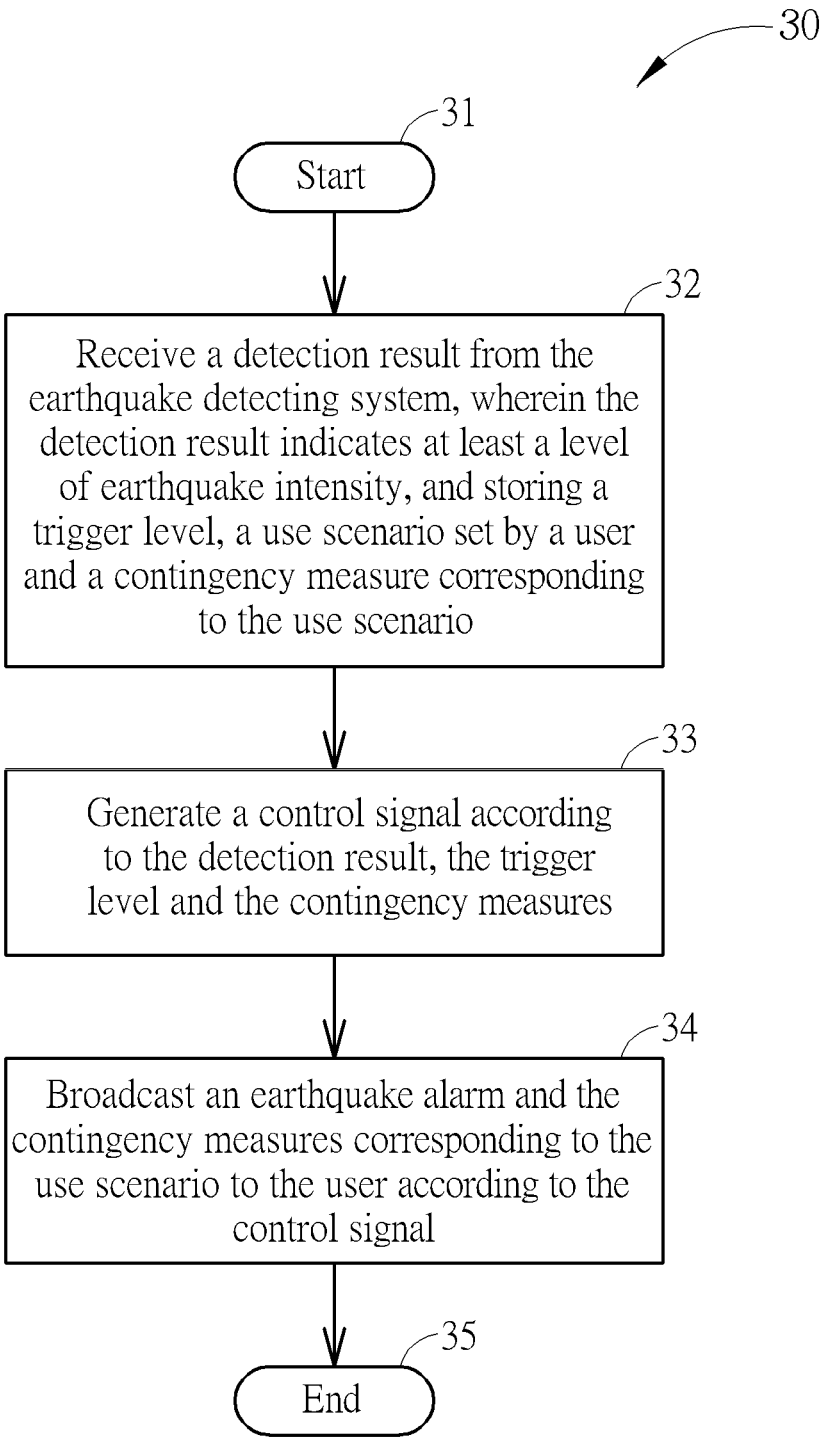
FIG. 3 is a schematic diagram of a process for broadcasting earthquake alarms according to an embodiment of the present invention.

Please refer to FIG. 3, which is an earthquake alarm broadcasting process 30 according to an embodiment of the present invention. The earthquake alarm broadcasting process 30 is used for the earthquake alarm broadcasting equipment 10 to broadcast the earthquake alarm and the corresponding contingency measure MSU to the users. The earthquake alarm broadcasting process 30 includes the following steps.

Step 31: Start.

Step 32: Receive a detection result from the earthquake detecting system, wherein the detection result indicates at least a level of earthquake intensity, and storing a trigger level, a use scenario set by a user and a contingency measure corresponding to the use scenario.

Step 33: Generate a control signal according to the detection result, the trigger level and the contingency measures.

Step 34: Broadcast an earthquake alarm and the contingency measures corresponding to the use scenario to the user according to the control signal.

Step 35: End.

Step 32 describes operations of the receiver 11 and the memory device 13, Step 33 describes operations of the processor 12, and Step describes operations of the functional module 14. Detailed operations of element and signals described in the process 30 may be obtained by referring to descriptions of the earthquake alarm broadcasting equipment 10, which is omitted. By the process 30, the earthquake alarm broadcasting equipment 10 may receive the earthquake detecting result detected by the earthquake detecting system 20 within its alarm range, thereby the earthquake alarm broadcasting equipment 10 may determine whether to broadcast the earthquake alarm and the contingency measure to the users.

Noticeably, please refer to FIG. 1 again, the earthquake alarm broadcasting system 1 may be regarded as an earthquake alarm broadcast network capable of instantly and locally providing earthquake detecting information as well as receiving earthquake detecting information from the earthquake observation center to make cross-reference, which minimizes a time of broadcasting the earthquake alarm and improves a correctness of the earthquake alarm. Preferably, in order to increase a penetration rate for building up the earthquake detecting system 20, the earthquake detecting system 20 may be designed with a simpler structure than the earthquake observation center 30 to save a build-up cost, it could be practical to the users to place the earthquake detecting system. 20 some places.

To sum up, the earthquake alarm broadcasting equipment of the present invention is capable of receiving the earthquake detecting result detected by earthquake detecting system within its alarm range to determine whether to broadcast the earthquake alarm and the corresponding contingency measure the users. As a result, the users may follow the contingency measure broadcasted by the earthquake alarm broadcasting equipment to protect them from life hazard and reduces property lost. The earthquake alarm broadcasting equipment of the present invention allows the usage scenario to be customized to provide the more suitable contingency measure to the users to cater to user requirements. In addition, by integrating the earthquake alarm broadcasting equipment in the electronic devices utilized in everywhere, the broadcast earthquake alarm may be widely sent to most of the users to take the corresponding contingency measure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An earthquake alarm broadcasting equipment for an on-site earthquake early warning system, comprising:

a receiver for receiving an on-site earthquake early warning result from the on-site earthquake early warning system, and a regional earthquake early warning result from a regional earthquake early warning system, wherein the on-site earthquake early warning system uses a local sensor to detect local seismic waves to generate the on-site earthquake early warning result, and the regional earthquake early warning system receives a plurality of local sensing signals simultaneously from a plurality of earthquake sensing subsystems to generate the regional earthquake early warning result;

a memory device for storing a trigger level, a use scenario set by a user, a contingency measure corresponding to the use scenario, and the regional earthquake information;

a processor coupled to the receiver and the memory device for generating a first control signal according to the on-site earthquake early warning result, the trigger level and the contingency measures, and generating a second control signal according to the on-site earthquake early warning result and the regional earthquake early warning result; and a functional module coupled to the processor for broadcasting an earthquake alarm and the contingency measures corresponding to the use scenario to the user according to the first or second control signal.

2. The earthquake alarm broadcasting equipment of claim 1, wherein the on-site earthquake early warning result at least indicates a level of earthquake intensity, and the processor determines whether to generate the first or second control signal according to the trigger level and the level of earthquake intensity indicated by the on-site earthquake early warning result.

3. The earthquake alarm broadcasting equipment of claim 2, wherein the processor generates the first or second control signal to the functional module according to the contingency measure corresponding to the usage scenario if the level of earthquake intensity indicated by the on-site earthquake early warning result is greater than the trigger level; and the processor does not generate the first or second control signal if the level of earthquake intensity indicated by the on-site earthquake early warning result is smaller than the trigger level.

4. The earthquake alarm broadcasting equipment of claim 1, wherein the usage scenario indicates at least a geologic, a region, an interior/exterior including high or low levels, a population density, an economic value of a building and a fragility.

5. A method of broadcasting earthquake alarm for an earthquake detecting equipment of an on-site earthquake early warning system, comprising:

receiving an on-site earthquake early warning result from the on-site earthquake early warning system, and a regional earthquake early warning result from a regional earthquake early warning system, wherein the on-site earthquake early warning system uses a local sensor to detect local seismic waves to generate the on-site earthquake early warning result, and the regional earthquake early warning system receives a plurality of local sensing signals simultaneously from a plurality of earthquake sensing subsystems to generate the regional earthquake early warning result;

generating a first control signal according to the on-site earthquake early warning result, the trigger level and the contingency measures, and generating a second control signal according to the on-site earthquake early warning result and the regional earthquake early warning result; and broadcasting an earthquake alarm and the contingency measures corresponding to the use scenario to the user according to the first or second control signal.

6. The method of claim 5, wherein the on-site earthquake early warning result at least indicates a level of earthquake intensity, and the method further comprising:

determining whether to generate the first or second control signal according to the trigger level and the level of earthquake intensity indicated by the earthquake on-site earthquake early warning result.

7. The method of claim 6, wherein determining whether to generate the first or second control signal according to the trigger level and the level of earthquake intensity indicated by the earthquake on-site earthquake early warning result comprises:

generating the first or second control signal to the functional module according to the contingency measure corresponding to the usage scenario if the level of earthquake intensity indicated by the on-site earthquake early warning result is greater than the trigger level; and not generating the first or second control signal if the level of earthquake intensity indicated by the on-site earthquake early warning result is smaller than the trigger level.

8. The method of claim 5, wherein the usage scenario indicates at least a geologic, a region, an interior/exterior including high or low levels, a population density, an economic value of a building and a fragility.

* * * * *